US009493920B2

(12) United States Patent
Raasch et al.

(10) Patent No.: US 9,493,920 B2
(45) **Date of Patent: *Nov. 15, 2016**

(54) AUTOMATICALLY ADJUSTABLE SNOWTHROWER CHUTE

(71) Applicant: Briggs & Stratton Corporation, Wauwatosa, WI (US)

(72) Inventors: Jason J. Raasch, Cedarburg, WI (US); Robert Koenen, Pewaukee, WI (US); Dan Brueck, Brookfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/604,254

(22) Filed: Jan. 23, 2015

(65) Prior Publication Data

US 2015/0128459 A1 May 14, 2015

Related U.S. Application Data

(63) Continuation of application No. 13/738,837, filed on Jan. 10, 2013, now Pat. No. 8,938,894.

(60) Provisional application No. 61/586,032, filed on Jan. 12, 2012.

(51) Int. Cl.
*E01H 5/04* (2006.01)

(52) U.S. Cl.
CPC ..... *E01H 5/045* (2013.01)

(58) Field of Classification Search
CPC ..... E01H 5/04; E01H 5/045; E01H 5/098
USPC ..... 37/196, 197, 244, 246, 248–253, 37/257–261
See application file for complete search history.

(56) References Cited

U.S. PATENT DOCUMENTS

| | | | |
|---|---|---|---|
| 3,075,813 | A | 1/1963 | Vohl |
| 3,088,779 | A | 5/1963 | Vachon |
| 3,484,963 | A | 12/1969 | Heth et al. |
| 3,497,263 | A | 2/1970 | Heth et al. |
| 3,509,977 | A | 5/1970 | Bacon |
| 3,552,045 | A | 1/1971 | Fieber |
| 3,808,715 | A | 5/1974 | Haban |
| 3,921,315 | A | 11/1975 | Tome |
| 4,068,397 | A | 1/1978 | Bacon |
| 4,138,829 | A | 2/1979 | Chase |
| 4,138,830 | A | 2/1979 | Chase |
| 4,184,274 | A | 1/1980 | Vohl |
| 4,312,143 | A | 1/1982 | Kado |
| 4,346,526 | A | 8/1982 | Mattson et al. |
| 4,376,345 | A | 3/1983 | Hochwitz |
| 4,409,748 | A | 10/1983 | Westimayer |
| 4,761,901 | A | 8/1988 | Szafarz |

(Continued)

OTHER PUBLICATIONS

Berco Snowblower Electric Chute and Deflector Kit Modification, Jan. 13, 2011 Forum Posting, www.mytractorforum.com/archive/index.php/t-162472-p-2.html, retrieved Jan. 10, 2012, 1 page.

*Primary Examiner* — Robert Pezzuto
(74) *Attorney, Agent, or Firm* — Foley & Lardner LLP

(57) ABSTRACT

A snowthrower includes a body, a chute rotatable relative to the body among a plurality of chute positions, wherein the chute is configured to discharge snow from the snowthrower, a motor for rotating the chute, a user input device configured to set a preferred chute bearing, and an electronic control unit configured to control the motor to automatically rotate the chute to an appropriate chute position to maintain the chute at the preferred chute bearing without additional input from the user input device.

19 Claims, 10 Drawing Sheets

(56) References Cited

U.S. PATENT DOCUMENTS

| | | | |
|---|---|---|---|
| 5,083,387 | A | 1/1992 | Tillotson et al. |
| 5,163,239 | A | 11/1992 | Lampe |
| 5,177,888 | A | 1/1993 | Thorud et al. |
| 5,315,771 | A | 5/1994 | White et al. |
| 5,351,423 | A | 10/1994 | Vohl |
| 5,444,927 | A | 8/1995 | Sosenko |
| 6,058,629 | A | 5/2000 | Peterson et al. |
| 6,487,798 | B2 | 12/2002 | Sueshige |
| 6,499,238 | B2 | 12/2002 | Kluck et al. |
| 6,568,106 | B2 | 5/2003 | Takeuchi |
| 6,684,535 | B2 | 2/2004 | Hancock et al. |
| 6,931,771 | B1 | 8/2005 | Liebl |
| 6,952,893 | B1 | 10/2005 | Sanderson |
| 7,032,333 | B2 | 4/2006 | Friberg et al. |
| 7,165,345 | B2 | 1/2007 | Beaudoin |
| 7,194,827 | B2 | 3/2007 | Mercer et al. |
| 7,347,013 | B2 | 3/2008 | Deschler et al. |
| 7,493,711 | B2 | 2/2009 | Gautreau et al. |
| 7,624,521 | B2 | 12/2009 | White et al. |
| 7,703,223 | B2 | 4/2010 | Walker et al. |
| 2002/0062582 | A1 | 5/2002 | Takeuchi |
| 2005/0144815 | A1 | 7/2005 | Girouard |
| 2006/0096134 | A1 | 5/2006 | Mercer et al. |
| 2006/0218823 | A1 | 10/2006 | Olmr et al. |
| 2006/0225309 | A1 | 10/2006 | Champagne et al. |
| 2007/0022638 | A1 | 2/2007 | Sueshige |
| 2007/0022639 | A1 | 2/2007 | Sueshige et al. |
| 2007/0089326 | A1 | 4/2007 | Girouard |
| 2008/0209771 | A1 | 9/2008 | Jerger et al. |

AUTOMATICALLY ADJUSTABLE SNOWTHROWER CHUTE

CROSS-REFERENCE TO RELATED PATENT APPLICATIONS

This application is a continuation of U.S. patent application Ser. No. 13/738,837, filed Jan. 10, 2013, now U.S. Pat. No. 8,938,894, which claims the benefit of Provisional Application No. 61/586,032, filed Jan. 12, 2012, all of which are incorporated herein by reference in their entireties.

BACKGROUND

The present disclosure relates to a snowthrower chute control system, and more particularly to an automatically adjusting chute control system using electronic compass guidance.

Both single-stage and dual-stage snowthrowers are commonly used to clear snow from driveways, sidewalks, patios, roadways, etc. Traditionally, the operator of the snowthrower has been required to manually adjust the directional output of the snowthrower chute in order to aim the thrown snow in a desired direction away from the space being cleared. Such manual adjustment is generally achieved via a user-manipulated crank arm located in proximity to other user controls of the snowthrower, wherein the crank arm activates a worm gear or belt system to rotate the chute to the desired position.

In order to adequately clear the desired space, the snowthrower operator generally makes multiple parallel passes within the space. At the end of each pass, the operator turns the snowthrower 180° and begins another pass. However, with each 180° turn, the operator also needs to manually adjust the output direction of the snowthrower chute. In order to do so, the operator will stop movement of the snowthrower, remove at least one hand from the controls, and manipulate the crank arm until the output of the chute is in the desired direction. This operation is repeatedly performed as the snow is cleared, causing the user to expend much of their time and energy to directing the output of the snow from the chute rather than operating the snowthrower itself.

More recently, automated systems for adjusting the directional output of the chute have been devised. These systems utilize electric motors and gear systems to rotate the chute based on the operator's manipulation of a toggle switch near the other system controls. While the user does not need to manually operate the crank arm or manually move the chute in any other way, these systems still require the user to stop the snowthrowing operation and adjust the directional output of the chute (via the toggle switch) at the end of each pass.

Therefore, it is desired to have a directional output control of a snowthrower chute that does not interrupt the snowthrowing operation and does not require user input continuously throughout.

SUMMARY

One embodiment of the invention relates to a snowthrower including a body, a chute rotatable relative to the body among a plurality of chute positions, wherein the chute is configured to discharge snow from the snowthrower, a motor for rotating the chute, a user input device configured to set a preferred chute bearing, and an electronic control unit configured to control the motor to automatically rotate the chute to an appropriate chute position to maintain the chute at the preferred chute bearing without additional input from the user input device.

Another embodiment of the invention relates to a snowthrower including, a body, a chute rotatable relative to the body among a plurality of chute positions, wherein the chute is configured to discharge snow from the snowthrower, a motor for rotating the chute, a flip user input device, and an electronic control unit configured to automatically control the motor to move the chute to a flip position one hundred eighty degrees from a current chute position upon actuation of the flip user input device.

Another embodiment of the invention relates to a snowthrower including a body, a chute rotatable relative to the body among a plurality of chute positions, wherein the chute is configured to discharge snow from the snowthrower, a motor for rotating the chute, a mirror user input device, and an electronic control unit configured to automatically control the motor to move the chute to a mirror position from a current chute position upon actuation of the mirror user input device, wherein the current chute position and the mirror position are equally and oppositely spaced from a snowthrower unit heading.

BRIEF DESCRIPTION OF THE DRAWINGS

The disclosure will become more fully understood from the following detailed description, taken in conjunction with the accompanying figures.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
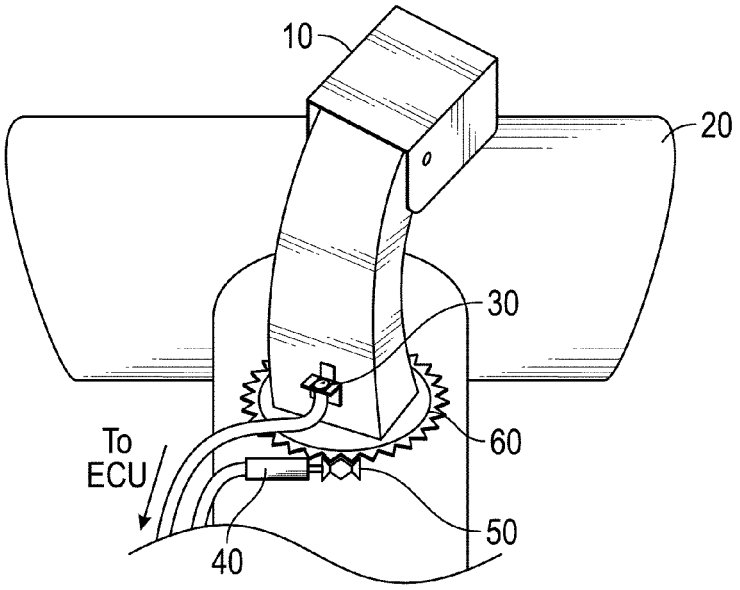
FIG. 1 is a cut-away view of a snowthrower chute with electronic compass disposed thereon in accordance with an exemplary embodiment.

Referring to FIG. 1, a cut-away view of a portion of a snowthrower chute control system in accordance with an exemplary embodiment is shown. Chute 10 is configured to direct snow gathered and propelled from auger or impeller housing 20 as the snowthrower is moved along a chosen path. The positioning of chute 10 is controlled based on directional readings from an electronic compass 30 disposed on chute 10. The directional data from electronic compass 30 is relayed to an electronic control unit (ECU) onboard the snowthrower, which controls operation of a reversible electric motor 40. A worm gear 50 is coupled to the shaft of reversible electric motor 40, wherein worm gear 50 interacts with a rotatable joint 60 to rotate chute 10 in a user-selected direction based on the directional data from electronic compass 30. That is, if the user chooses to propel snow to the right of the snowthrower on their initial pass, chute 10 maintains this output direction, even as the snowthrower is rotated 180° (or some other degree of rotation) with each respective parallel pass. Thus, chute 10 is likewise rotated 180° with each respective parallel pass based on an initial, user-chosen directional input, thereby continuously propelling the snow in a chosen direction without further user manipulation or input.

Figure 2:
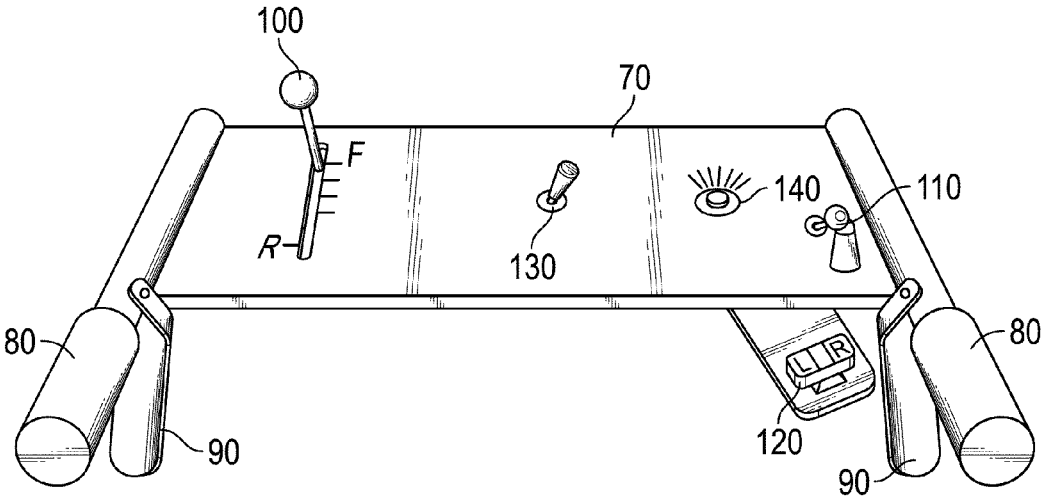
FIG. 2 is a top view of snowthrower controls in accordance with an exemplary embodiment.

FIG. 2 illustrates a snowthrower control interface in accordance with an exemplary embodiment. An interface deck 70 comprises a plurality of controls used to operate the snowthrower. The control interface further includes handles 80 and drive levers 90. Drive levers 90 control the drive wheel engagement of the snowthrower and/or auger or impeller engagement. A drive speed/direction lever 100 is located on interface deck 70, as is an ignition switch 110. A chute direction/position switch 120 is also located on interface deck 70 near one of handles 80. Chute direction/position switch 120 enables the user to rotate chute 10 to the left or right without necessarily removing their hands from handles 80 and/or drive levers 90. While FIG. 2 illustrates chute direction/position switch 120 located near the right handle 80, this position is not limiting and chute direction/position switch 120 may be located at any appropriate area on interface deck 70. Chute direction/position switch 120 may also be any appropriate multi-position switch, such as a toggle switch.

Referring still to FIG. 2, interface deck 70 further comprises a mode selection switch 130. Mode selection switch 130 enables the user to select between two modes of chute operation: manual mode and compass mode. As will be described in more detail herein, selection of manual mode requires the user to toggle chute direction/position switch 120 to change the directional position of chute 10. On the other hand, compass mode enables the user to select an initial directional position of chute 10 via chute direction/position switch 120, and chute 10 is automatically rotated to that position based on directional data gathered from electronic compass 30 as the user manipulates the snowthrower. Interface deck 70 also includes a mode indicator 140 which visually indicates to the user when the snowthrower is or is not in compass mode. Mode indicator 140 may be a lamp or other appropriate visual indicator.

Figure 3:
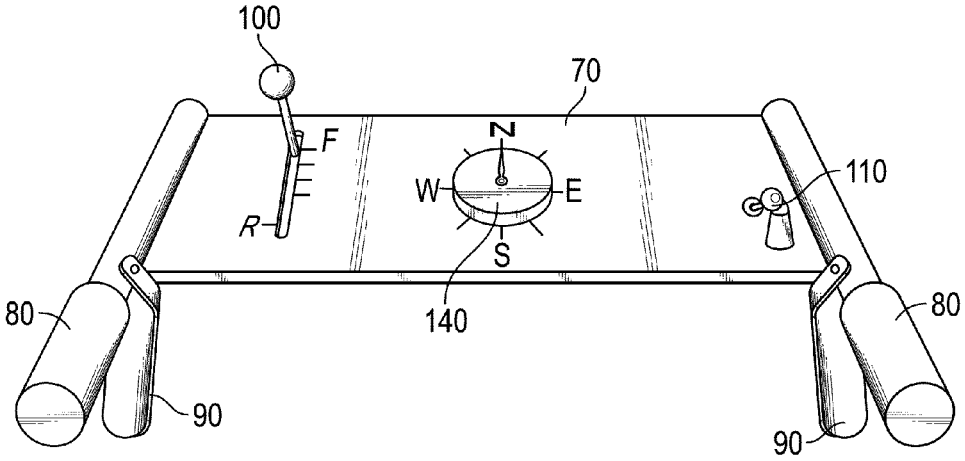
FIG. 3 a top view of snowthrower controls in accordance with another exemplary embodiment.

Referring now to FIG. 3, another exemplary embodiment of a snowthrower control interface is shown. In this embodiment, interface deck 70 includes a control knob 140 for setting the chute direction, as opposed to chute direction/position switch 120 shown in FIG. 2. The user may select any desired direction on control knob 140, which communicates with the ECU to direct chute 10 to that desired heading throughout travel of the snowthrower.

Figure 4:
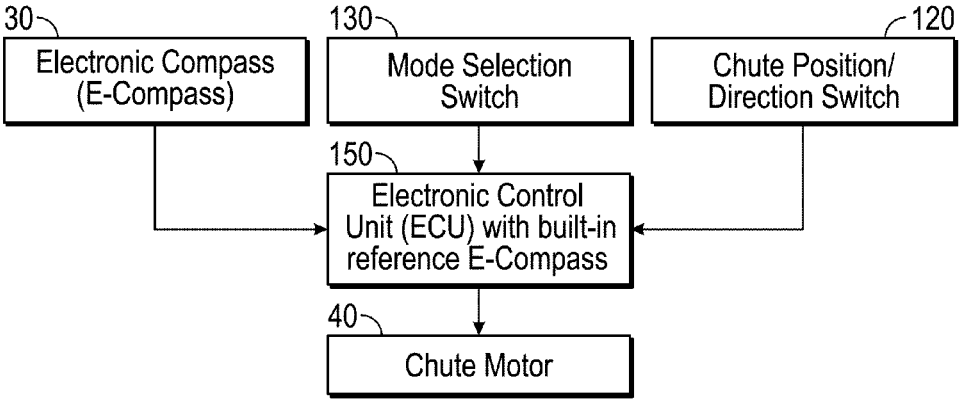
FIG. 4 is a schematic diagram of a snowthrower chute control system in accordance with an exemplary embodiment.

FIG. 4 illustrates a schematic diagram of the snowthrower chute control operation according to an exemplary embodiment. As was similarly described above with respect to FIGS. 1 and 2, an electronic compass 30, mode selection switch 130, and chute position/detection switch 120 each communicate with an ECU 150. Based on the inputs from electronic compass 30, mode selection switch 130, and chute position/detection switch 120, ECU 150 controls reversible electric motor 40 to rotate chute 10 to the desired directional position. It is also noted that ECU 150 contains therein a reference electronic compass separate from electronic compass 30 disposed on chute 10. The reference electronic compass within ECU 150 accounts for the actual orientation of the snowthrower at any given moment and acts as a reference from which ECU 150 controls the rotation of chute 10 based on the positional data received from electronic compass 30 located on chute 10. As will be described in further detail below, using the reference point provided by the reference electronic compass within ECU 150 and the readings of electronic compass 30 disposed on chute 10 enables the system to maintain a desired chute heading, but only within a prescribed chute travel arc length.

In some embodiments, an ECU (or microcontroller) is in communication with a chute-mounted electronic compass, a reference electronic compass, chute direction control switches, a mode selection switch, and a chute rotation motor. Based upon user input received from the chute direction control switches and mode selection switch, as well as input received from the reference electronic compass and chute mounted electronic compass, the ECU controls the chute rotation motor so as to automatically rotate the chute to a desired position, and potentially to maintain that desired position throughout operation of the snowthrower or until the user chooses a different desired position. The ECU is programmable by an external PC, laptop, etc. via a USB connection or other appropriate external data link.

Figure 5:
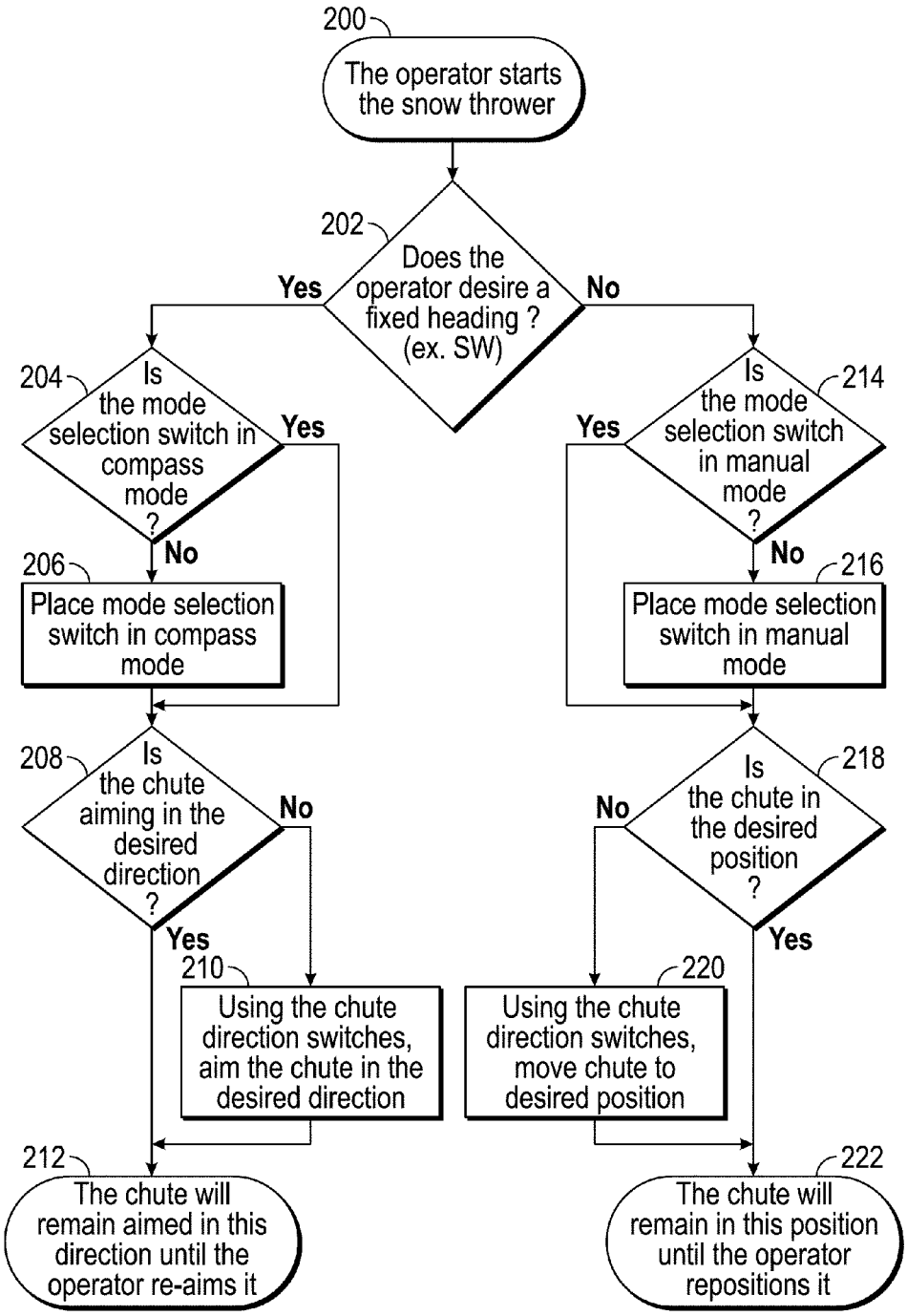
FIG. 5 is a flowchart describing user interaction with a snowthrower chute control system in accordance with an exemplary embodiment.

Next, FIG. 5 shows a user interaction flowchart in accordance with the exemplary embodiment shown and described with respect to FIGS. 1 and 2. At step 200, the operator/user starts the snowthrower. At step 202, the operator determines whether or not they wish to assign a fixed heading for the chute during operation (e.g., southwest, east, etc.). If yes, a determination is made at step 204 as to whether or not the mode selection switch is in compass mode. If no, the operator places the mode selection switch into compass mode at step 206. If yes, a determination is made at step 208 as to whether or not the chute is aiming in the desired direction. If no, the operator aims the chute in the desired direction via the chute direction switches at step 210. If yes, at step 212, the chute will remain aimed in the desired direction until the operator re-aims the chute using the chute direction switches.

Conversely, if the operator does not assign a fixed heading for the chute at step 202, a determination is made as to whether or not the mode selection switch is in manual mode at step 214. If no, the operator places the mode selection switch in manual mode at step 216. If yes, a determination is made as to whether or not the chute is in the desired position at step 218. If no, at step 220, the user moves to chute to the desired position using the chute direction switches. If yes, at step 222, the chute will remain in the desired position until the operator desires repositioning.

Figure 6:
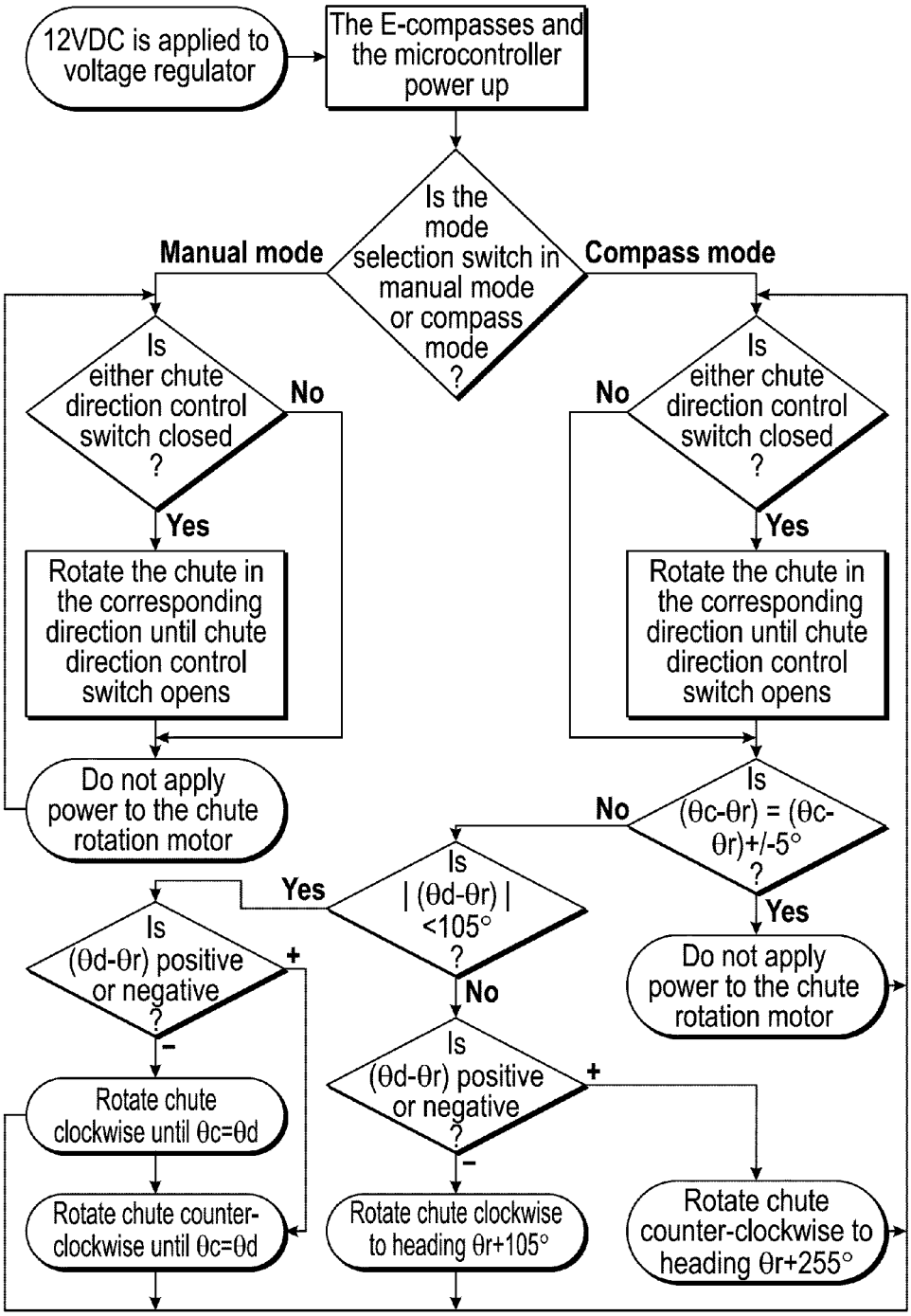
FIG. 6 is a flowchart describing control logic of a snowthrower chute control system in accordance with an exemplary embodiment.
Figure 7:
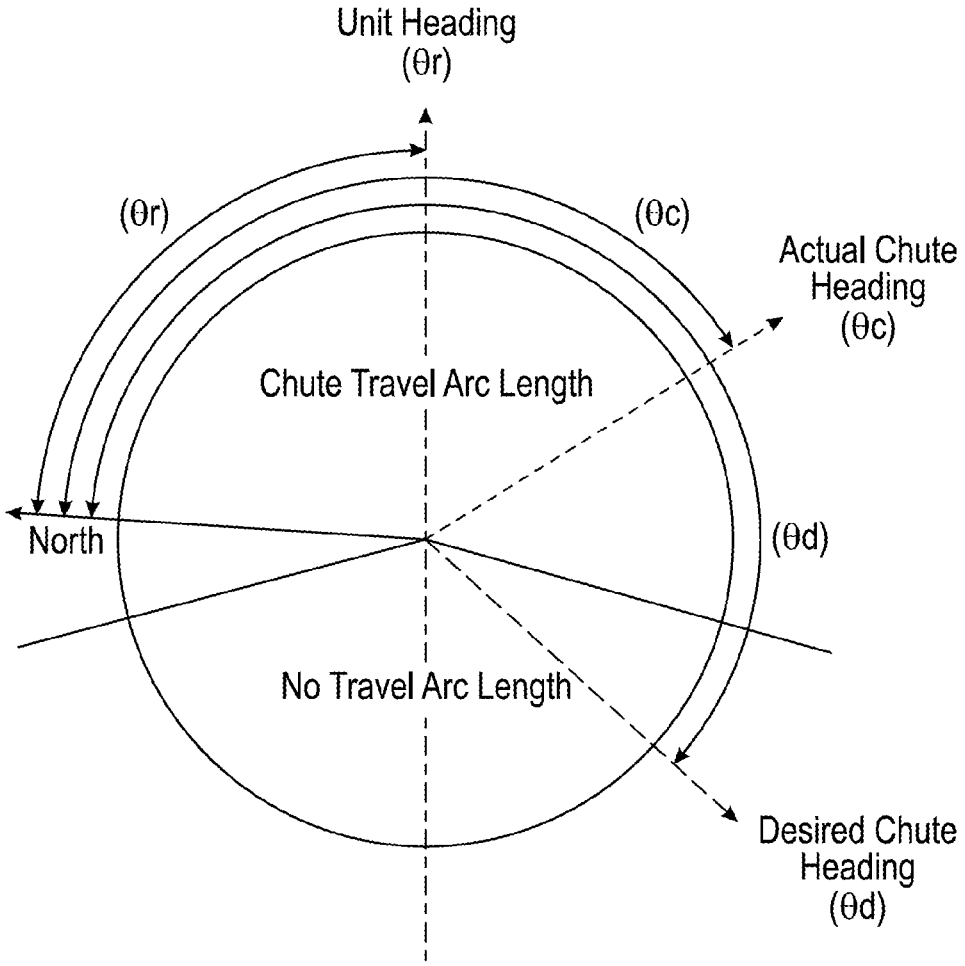
FIG. 7 is a snowthrower chute heading diagram in accordance with the exemplary embodiment shown with respect to FIG. 6.

Next, FIG. 6 shows a control logic flowchart in accordance with an exemplary embodiment. As described above, the ECU/microcontroller uses inputs and rules to determine whether or not to rotate the chute. In manual mode, the system operation is simple. If the left chute position switch is closed, the microcontroller rotates the chute counterclockwise. If the right chute position switch is closed, the microcontroller rotates the chute clockwise. If neither chute position switch is closed, the microcontroller will not activate the motor in either direction. However, in compass mode, the microcontroller is constantly monitoring the chute position. If the actual chute heading is within some tolerance (i.e., 5 degrees) of the desired chute heading, then the chute is not rotated. If the actual chute heading is out of the acceptable range, the microcontroller undergoes a series of decisions to determine the correct course of action, as shown in FIG. 6. Because most snow thrower chutes have limited rotation (i.e., 210 degrees), it is important that the microcontroller be able to determine the position of the chute relative to the snow thrower chassis. Without this capability, the microcontroller might attempt to rotate the chute beyond its rotatable range. The microcontroller is able to determine the position of the chute relative to the chassis by comparing the chute electronic compass heading with the ECU's onboard electronic compass heading (also referred to as the reference compass). Knowing this, the microcontroller can determine whether the desired chute heading is within the chute travel arc length. Using the heading diagram shown in FIG. 7 as a reference, the determination of whether the desired chute heading is within the chute travel arc length is calculated by taking the absolute value of the difference between the desired chute heading ($\theta d$) and the unit heading ($\theta r$). If this value exceeds ½ of the chute travel arc length, the desired chute heading is out of the chute travel arc length and is therefore unachievable. At this point the microcontroller subtracts the unit heading ($\theta r$) from the desired chute heading ($\theta d$). If the resulting value is positive, the microcontroller rotates the chute counterclockwise to a heading of $\theta r-½$ of the chute travel arc length. Likewise, if the resulting value is negative, the microcontroller rotates the chute clockwise to a value of $\theta r+½$ of the chute travel arc length. If the absolute value of the difference between the desired chute heading ($\theta d$) and the unit heading ($\theta r$) is less than ½ of the chute travel arc length, the desired chute heading is in the chute travel arc length and can be achieved. At this point the microcontroller subtracts the unit heading ($\theta r$) from the desired chute heading ($\theta d$). If the resulting value is positive, the microcontroller rotates the chute counterclockwise until the actual chute heading matches the desired chute heading. If the resulting value is negative, the microcontroller rotates the chute clockwise until the actual chute heading matches the desired chute heading.

Figure 8:
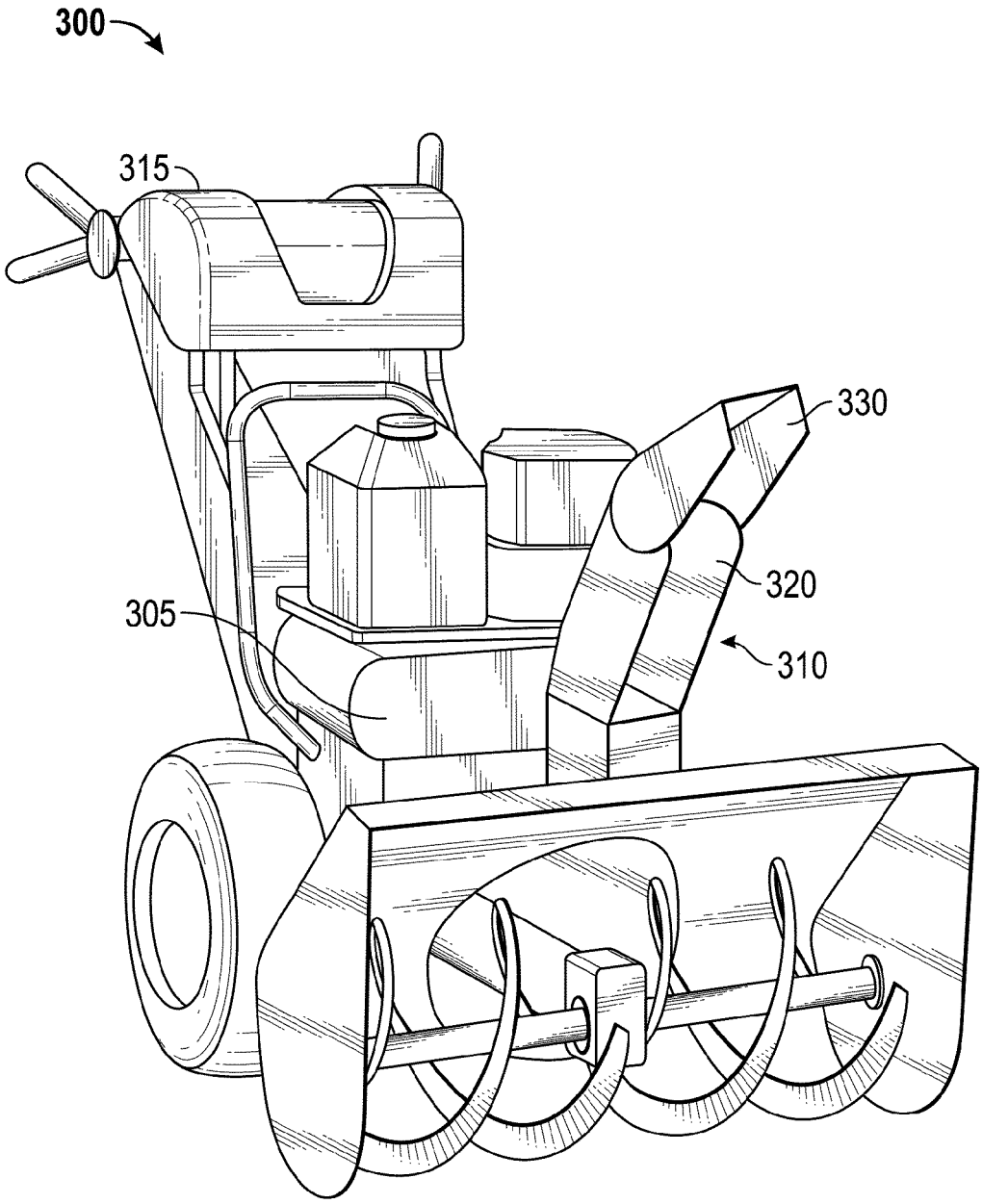
FIG. 8 is a perspective view of snowthrower in accordance with an exemplary embodiment.
Figure 9:
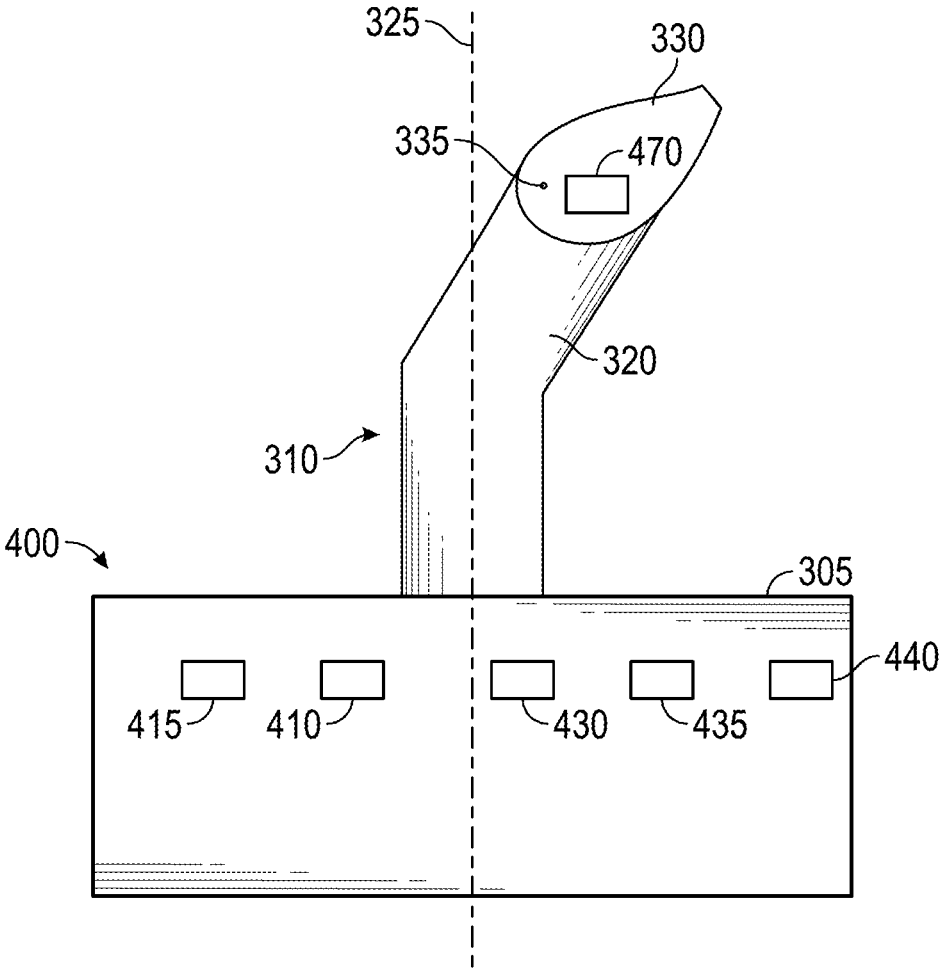
FIG. 9 is a schematic representation of the snowthrower of FIG. 8.

Referring to FIGS. 8-9, a snowthrower 300 is illustrated. The snow thrower 300 includes a body 305, a chute 310 rotatable relative to the body 305, and a control interface 315 (e.g., the control interfaces described with respect to FIGS. 2 and 3 above) for controlling operation of various components of the snowthrower 300. The chute 310 includes a neck or main portion 320 rotatably coupled to the body 305 for rotation about a vertical axis 325 (FIG. 9). The chute 310 also includes a deflector 330 rotatably coupled to the neck 320 for rotation about a horizontal axis 335 (FIG. 9). Snow travels through the neck 320 and is discharged through the deflector 330. The direction of discharge is controlled by the position of the neck 320 relative to the body 305. The angle of discharge is controlled by the position of the deflector 330 relative to horizontal.

A chute position control system 400 controls the direction of discharge by rotating the chute 310 relative to the body 305. The chute position control system 400 includes a motor 405 for rotating the chute 310 relative to the body 305, a chute direction switch 410, and an electronic control unit or processing circuit 415 that controls the other components of the chute position control system 400. In some embodiments, the electronic control unit 415 also controls various other components of the snowthrower 300. The motor 405 and the chute direction switch 410 are both connected to the electronic control unit 415 so that user input to the chute direction switch 410 causes the motor 405 to rotate the chute 310. As used herein, the chute position is the position of the chute 310 relative to the body 305, the snowthrower bearing is the direction of forward travel of the snowthrower 300 (e.g., the compass bearing of the snowthrower 300), and the chute bearing is the compass bearing of the direction of discharge of the chute 305.

The electronic control unit 415 or processing circuit can include a processor and memory device. The processor can be implemented as a general purpose processor, an application specific integrated circuit (ASIC), one or more field programmable gate arrays (FPGAs), a group of processing components, or other suitable electronic processing components. The memory device (e.g., memory, memory unit, storage device, etc.) is one or more devices (e.g., RAM, ROM, Flash memory, hard disk storage, etc.) for storing data and/or computer code for completing or facilitating the various processes, layers and modules described in the present application. The memory device may be or include volatile memory or non-volatile memory. The memory device may include database components, object code components, script components, or any other type of information structure for supporting the various activities and information structures described in the present application. According to an exemplary embodiment, the memory device is communicably connected to processor via processing circuit and includes computer code for executing (e.g., by processing circuit and/or processor) one or more processes described herein.

In some embodiments, the electronic control unit 415 uses pulse width modulation ("PWM") to control the speed of the motor 405 by controlling the duty cycle of the voltage provided to the motor 405. This helps to avoid sudden or imprecise chute positioning in as controlled by the motor 405. PWM control also allows the electronic control unit to increase the duty cycle of the motor in response to frozen, jammed, or stuck components, or to maintain the preferred motor speed if the output voltage of the motor's power supply (e.g., battery, alternator, etc.) has decreased. In some embodiments, a proportional-integral-derivative ("PID") controller is used to vary the duty cycle and direction of the motor. The PID controller helps to minimize the error between a target or preferred chute position and a detected chute position.

Figure 10:
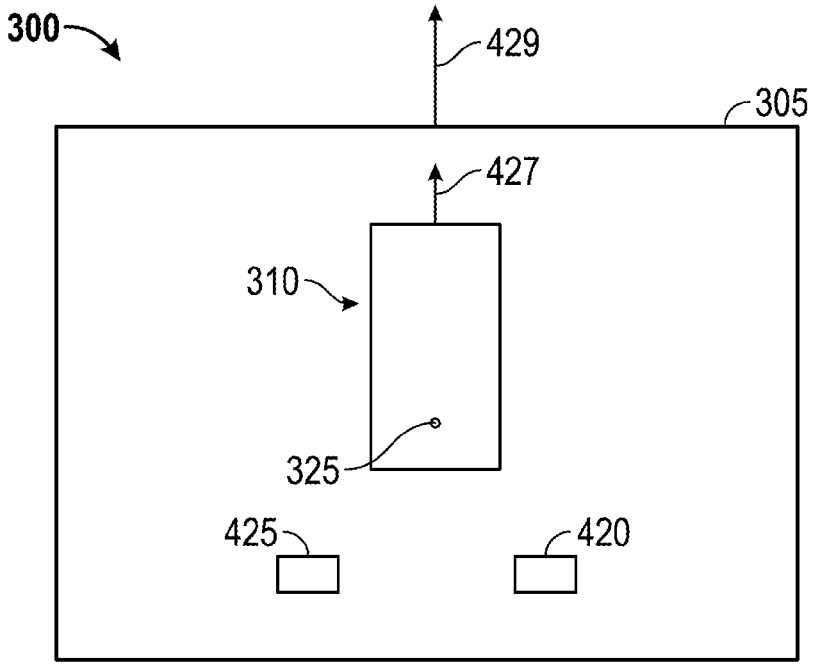
FIG. 10 is a schematic representation of the snowthrower of FIG. 8 with a chute in a first position.
Figure 11:
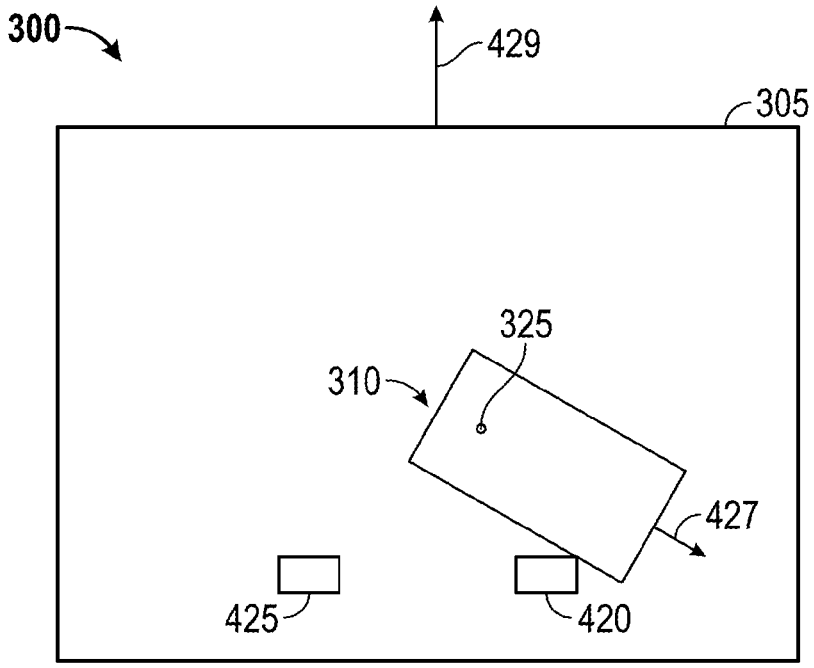
FIG. 11 is a schematic representation of the snowthrower of FIG. 8 with the chute in a second position.
Figure 12:
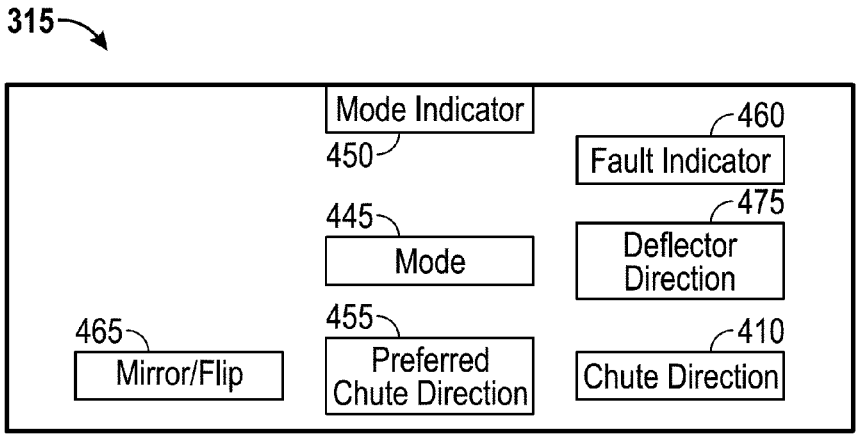
FIG. 12 is a schematic representation of a control interface of the snowthrower of FIG. 8.

As shown in FIGS. 10-11, in some embodiments, a pair of limit switches 420, 425 (e.g., Hall-effect position sensors or other appropriate actuators) prevent the chute 310 from rotating past a set clockwise turning limit or angular limit of travel (by limit switch 420) and a set counterclockwise turning limit or angular limit of travel (by limit switch 425). FIG. 10 illustrates the chute 305 at a chute position where the chute bearing 427 matches the snowthrower bearing 429 (i.e., the chute 305 is positioned at 0°). FIG. 11 illustrates the chute 305 at one of its angular limits of travel where the limit switch 420 is actuated (e.g. 105° clockwise). In some embodiments, mechanical stops also prevent the chute 305 from rotating past its turning limit. The chute 310 is typically not able to rotate a full 360°, either for mechanical reasons (e.g., an obstruction on the body 305 preventing such rotation) and/or for user comfort reasons (e.g., to prevent user from directing the discharged snow at himself). In some embodiments, the chute's range of angular or rotational travel is 210° In some embodiments, the limit switches 420, 425 are evenly spaced relative to the forward direction of travel of the snowthrower 300 (e.g., where the forward direction of travel of the snowthrower 300 is at 0°, the limit switch 420 is at 105° clockwise and the limit switch 425 is at 105° counterclockwise). The limit switches 420, 425, are connected to the motor 405, the electronic control unit 415, or both to stop the motor 405 when either limit switch 420, 425 is actuated to prevent further rotation of the chute 310 in the direction of the actuated limit switch 420, 425. Once one of the limit switches 420, 425 is actuated, the motor 405 can only be activated to rotate the chute 310 away from the actuated limit switch 420, 425. In some embodiments, the chute 310 includes one or more projections or other appropriate actuators configured to contact or otherwise actuate the limit switches 420, 425.

The chute position control system 400 also includes a chute position detector 430. The chute position detector 430 is connected to the electronic control unit 415 (e.g., a wired connection, a wireless connection) and is configured to detect the position of the chute 310 relative to the body 305. This chute position is measured relative to the snowthrower bearing (i.e., the forward direction of travel of the snowthrower 300). Using this convention, the chute position aligned with the forward direction of travel of the snowthrower 300 is 0° and changes from 0° are measured in degrees clockwise or counterclockwise from the perspective of a user operating the snowthrower 300 with clockwise having a positive value and counterclockwise having a negative value.

In some embodiments, the chute position detector 430 is a position sensor. The position sensor can be an encoder or other rotary position sensor, (e.g., a gear tooth sensor that counts gear teeth as the chute 410 rotates), a magnetometer or compass mounted to the chute 310, an infrared ("IR") position sensor, etc. In some embodiments, the position sensor is mounted to the body 305, not the chute 310, which simplifies physically connecting the position sensor to the electronic control unit 415.

Figure 14:
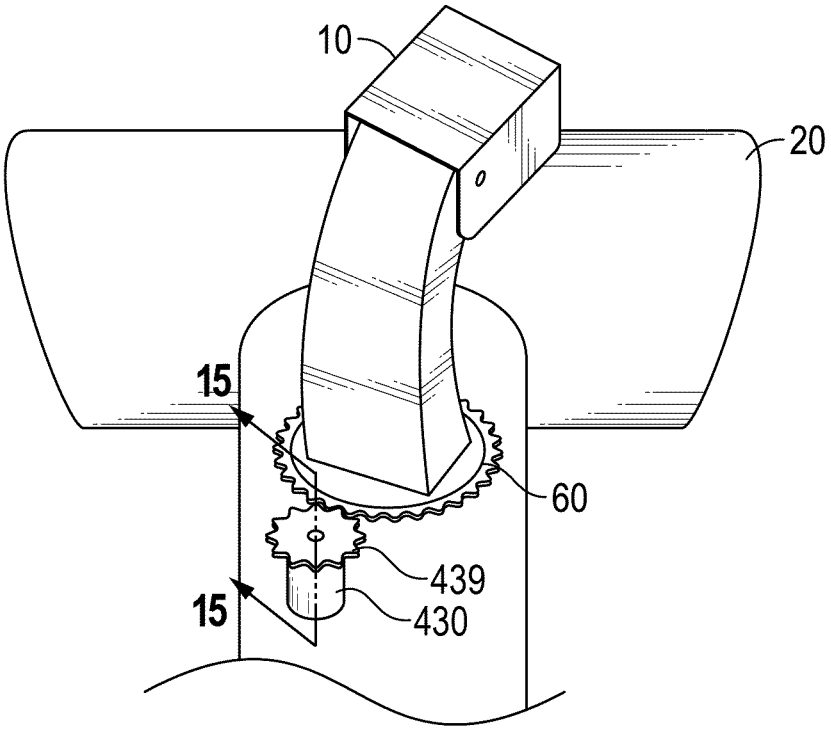
FIG. 14 is a cross-sectional view of a chute position detector in accordance with an exemplary embodiment.
Figure 15:
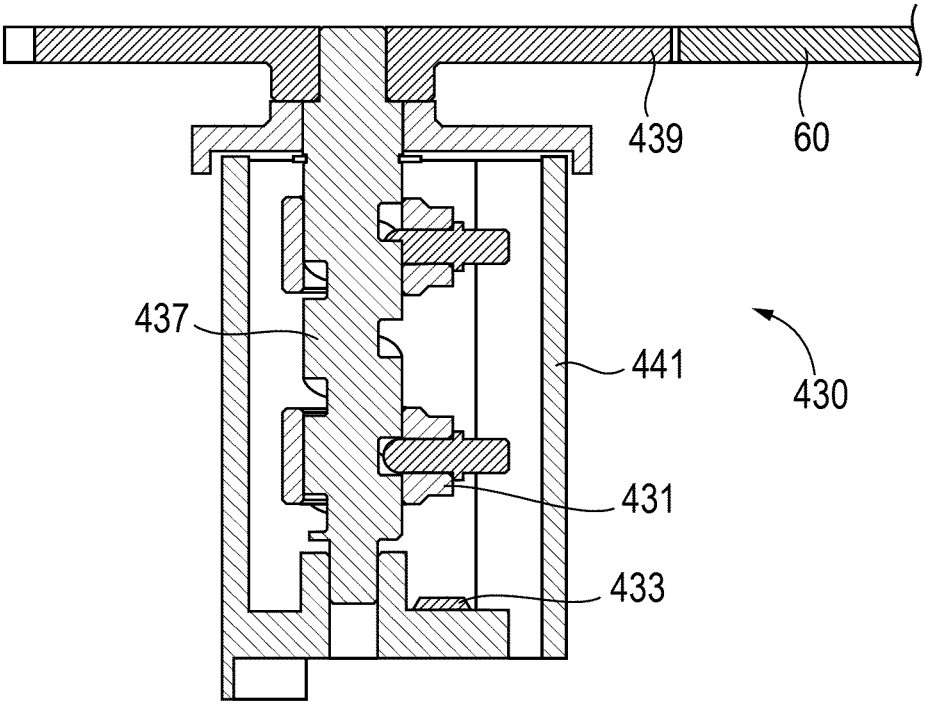
FIG. 15 is a schematic representation of the chute position detector of FIG. 14 and other components of a snowthrower.

Referring to FIGS. 14-15, in some embodiments, the chute position detector 430 is a non-contact position sensor or potentiometer. The chute position detector includes a target member (e.g. a reflector 431), a position sensor (e.g. an optical sensor 433), and a lead screw 437. The reflector 431 is coupled to the lead screw 437, so that the reflector 431 moves linearly along the lead screw 437 as the lead screw 437 rotates. The optical sensor 433 detects the distance between itself and the reflector 431. For example, a change in distance between the reflector 431 and the optical sensor 433 produces a corresponding change in a voltage or signal provided by the optical sensor 433 to the electronic control unit 415. The lead screw 437 is mechanically coupled to the chute 310, for example, by one or more gears 439. In some embodiments, a first gear is coupled to the chute 310 and the motor 410, so that the motor 405 rotates the chute 305 by rotating the first gear. One or more gears 439 are coupled to the first gear so that the first gear also rotates the one or more gears 439. Mechanically coupling the lead screw 437 to the chute 310 causes the reflector 431 to move along the lead screw 437 in proportion to the rotation of the chute 310. This allows the position of the reflector 431 relative to the optical sensor 433 to be used to indicate the chute position. In some embodiments, the target member is a magnet and the position sensor is a Hall effect or other magnetic sensor. In some embodiments, the target member, position sensor, and lead screw 437 are protected from the elements by a housing or cover 441.

In some embodiments, a stepper motor functions as both the motor 405 and the chute position detector 430.

In some embodiments, the motor 405 or the chute 305 is biased to the zero position (i.e., where the chute position is on the same bearing as the direction of forward travel of the snowthrower 300). The chute 305 is moved among known positions based on the magnitude and polarity of the voltage supplied to the motor 405. For example, a maximum positive voltage is applied to the motor 405 to move the chute 305 to its angular limit of travel (e.g. 105°) in the clockwise direction, a maximum negative voltage is applied to the motor 405 to move the chute 305 to its angular limit of travel (e.g. −105°) in the counterclockwise direction, and no voltage is applied to the motor 405 to allows the chute 305 to return to the zero position (e.g. 0°). In this way, the chute position is detected or known based on the magnitude and polarity of the voltage applied to the motor 405 and the motor 405 functions as both the motor 405 and the chute position detector 430.

In some embodiments, the chute position detector 430 is micro electric mechanism system ("MEMS") motion sensor or an accelerometer. The MEMS motion sensor or accelerometer is mounted to the chute 310 and connected to the electronic control unit 415 (e.g., a wired connection, a wireless connection).

In some embodiments, the chute position control system 400 also includes a compass sensor 435 (e.g., a two-axis magnetometer, a MEMS motion sensor, an accelerometer). The compass sensor 435 is connected to the electronic control unit 415 (e.g., a wired connection, a wireless connection) and is configured to detect the bearing of the snowthrower 300 (e.g., the bearing of the forward direction of travel relative to the compass directions). The compass sensor 435 is mounted to the body 305 (i.e., not to the chute 310). The electronic control unit 415 is able to compare the bearing of the snowthrower 300 as detected by the compass sensor 435 to the position of the chute 310 as detected by the chute position detector 430 to implement various operating modes that are discussed in more detail below. In some embodiments, the compass sensor 435 includes an accelerometer and a magnetometer to account for a tilt angle of the snowthrower 300 when determining the bearing of the snowthrower 300.

In some embodiments, the chute position control system 400 also includes a global positioning system ("GPS") sensor 440. The GPS sensor 440 is connected to the electronic control unit 415 (e.g., a wired connection, a wireless connection) and is configured to detect the location of the snowthrower 300. The electronic control unit 415 is able to compare the location of the snowthrower 300 to one or more other inputs, including the bearing of the snowthrower 300 as detected by the compass sensor 435 and the position of the chute 310 as detected by the chute position detector 430, to implement various operating modes that are discussed in more detail below.

The control interface 315 includes the chute direction switch 410 and other user input devices necessary to implement the various embodiments of the chute position control system 400 described herein. Such input devices can be actuators, switches, buttons, touch screens, levers, or other appropriate devices configured to be manipulated by the user. In some embodiments, the control interface 315 includes a mode selection switch 445 that is used to select among the various operating modes provided by the chute position control system 400. The mode selection switch 445 itself and/or a mode indicator 450 (e.g., a light, a display on a screen) indicate the selected mode to the user. In some embodiments, a preferred chute direction switch 455 allows the user to set the preferred chute direction (discharge direction). Other user controls can function as a preferred chute direction switch 455 or to actuate the preferred chute direction switch 455. For example, actuation of the auger control lever or drive wheel control lever could be used to set the preferred chute direction. In some embodiments, an overtravel or fault indicator 460 (e.g. a light, a display on a screen, an speaker or other audible alarm) is used to indicate to the user when the motor 405 attempts to rotate the chute 310 outside of the chute's range of rotational travel or to indicate other faults in the operation of the chute position control system 400. In some embodiments, a mirror/flip switch 465 is actuated to change the chute position according to a mirror operating mode or a flip operating mode, as described below.

In a manual operating mode, the chute position control system 400, the user actuates the chute direction switch 410 to move the chute 310 to the desired chute position. The user is free to move the chute 310 to any position within the chute's range of rotational travel. Movement outside the chute's range of rotational travel can be prevented by limit switches 420, 425 as described above or by limits imposed by the electronic control unit 415 based on the chute position detected by the chute position detector 430.

In a mirror operating mode, the chute position control system 400 automatically changes the chute position when the mirror/flip switch 465 is actuated by the user. The user sets the preferred chute position with the chute direction switch 410 and clears snow by moving the snowthrower along a first bearing. When the user turns the snowthrower 300 to a second bearing opposite the first bearing, he actuates the mirror switch 465, thereby causing the motor 405 to move the chute 310 to a mirror chute position. The preferred chute position and the mirror chute position have the same absolute value (i.e., a preferred chute position of 25° has a mirror chute position of −25°). Subsequent actuation of the flip/mirror switch 465 returns the chute 305 to the preferred chute position. In some embodiments, the preferred chute position is stored in the electronic control unit 415 by actuating the preferred chute direction switch 455. In other embodiments, the preferred chute position is not saved or stored, but rather the chute position immediately prior to actuation of the mirror/flip switch 265 is used as the preferred chute position to calculate the mirror chute position.

A flip operating mode is similar to the mirror operating mode. In the flip operating mode, actuation of the mirror/flip switch 465 causes the motor to move the chute from the preferred chute position to a flip shoot position 180° opposite the preferred chute position. In some embodiments, if the chute 305 cannot perform the 180° flip without exceeding its range of rotational travel, the overtravel or fault indicator 460 is activated. In other embodiments, the indicator 460 is not activated in this situation. In some embodiments, when the flip position would result in an overtravel condition, the chute 305 can either be moved as close to the flip position as possible or the chute position control system 400 can switch to the manual operating mode.

In a compass guidance operating mode, the chute position control system 400 automatically changes the chute position to maintain a preferred chute bearing as the snowthrower bearing changes. The user selects the preferred chute bearing. This can be done in several ways. The user must first move the chute 305 to the desired position (e.g. by using the chute direction switch 410). This position is saved or stored in the electronic control unit 415 (e.g., when the preferred chute direction switch 445 is actuated, when the mode selection switch 445 is moved from manual to compass mode, or other appropriate manner). As the user operates the snowthrower 300, the electronic control unit 415 will compare the current chute position as determined by the chute position detector 430 to the current snowthrower bearing as determined by the compass sensor 435 and cause the motor 405 to move the chute 305 so that the direction of discharge of the chute 305 is maintained at the preferred chute bearing. This maintains the direction of discharge on the same compass bearing as the user manipulates the snowthrower 300 (e.g., on a curved driveway, as the user makes multiple passes in different directions). In some embodiments, if the preferred chute bearing would require the chute 305 to exceed its range of rotational travel, the overtravel or fault indicator 460 is activated. In other embodiments, the indicator 460 is not activated in this situation. In some embodiments, when the preferred chute bearing would result in the chute 305 moving to an overtravel condition (e.g., actuating one of the limit switches 420, 425), the chute 305 can either be moved as close to the preferred chute bearing as possible or the chute position control system 400 can switch to the manual operating mode.

In some embodiments, averaging of one or more sensor outputs (e.g., from the chute position detector 430 and the compass sensor 435) is used to eliminate possible noise (e.g., electrical or magnetic) from these outputs. For example, the output from the compass sensor 435 results in a bearing value in the range of 0.0° to 359.9°, with magnetic North centered around 0° (360°). When the bearing is at or close to magnetic North, the rapid change from 0.0° to 359.9° results in difficulties in averaging the compass bearing (e.g., output of the compass sensor 435). The following averaging algorithm can be used to prevent large discrepancies in the average compass bearing. If the average compass bearing is greater than 340° and the current compass bearing is less than 20°, then the current compass bearing is set to the current compass bearing plus 360'; the average compass bearing is then recalculated and if the average compass bearing is greater than or equal 360°, then the average compass bearing is set to the average compass bearing minus 360°. If the average compass bearing is less than 20° and the current compass bearing is greater than or equal to 340°, then the current compass bearing is set to the current compass bearing minus 360°; the average compass baring is then recalculated and if the average compass bearing is less than 0°, then the average compass bearing is set to the average compass bearing plus 360°.

Figure 13:
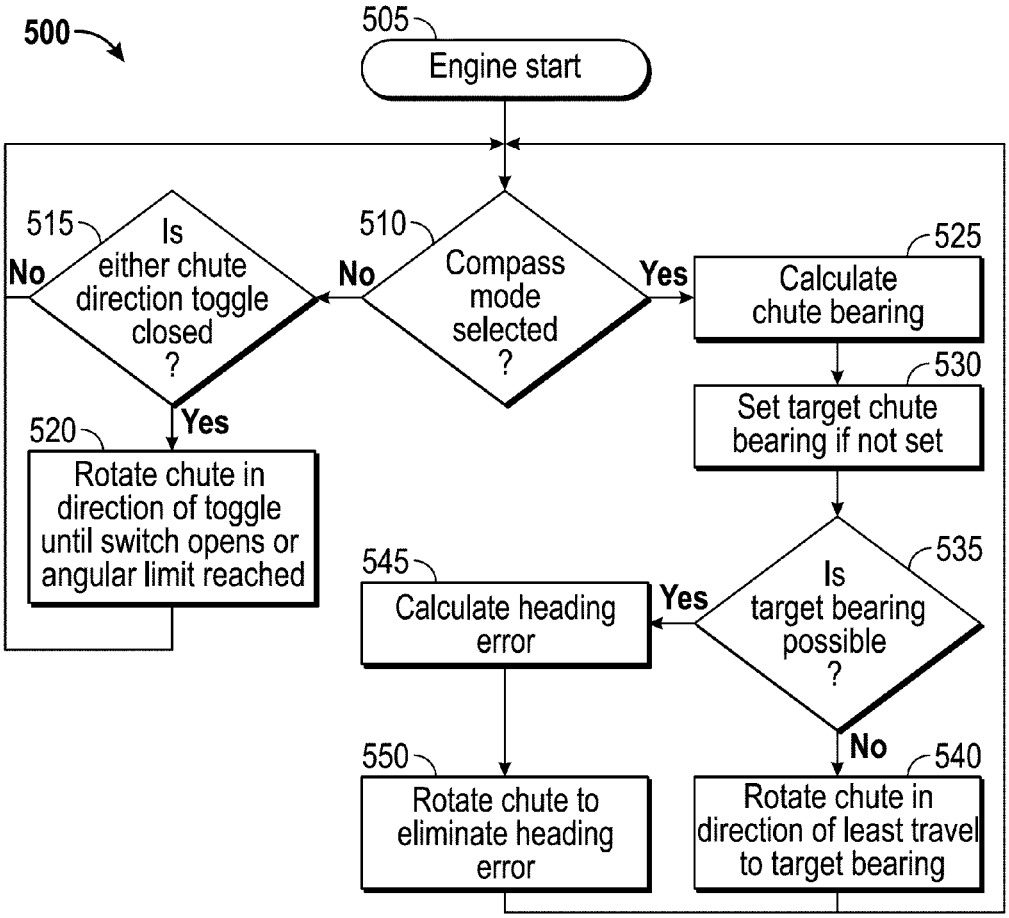
FIG. 13 is a flow chart describing control logic of a chute position control system in accordance with an exemplary embodiment.

Referring to FIG. 13, a method 500 of operating a chute of a snowthrower is illustrated according to an exemplary embodiment. After the engine of the snowthrower 300 is started and the electronic control unit 415 is powered (step 505), the electronic control unit 415 determines if the compass mode is selected or if the manual mode is selected (e.g., based on the output from the mode selection switch 445) (step 510). If manual mode is selected, if the chute direction switch 410 is actuated (step 515), the motor 410 rotates the chute 305 until the chute direction switch 410 is released or the angular limit of the chute's travel (e.g., one of limit switches 420, 425) is reached (step 520).

If the compass mode is selected, the current chute bearing is calculated (step 525) and the preferred chute bearing is set, if it was not previously set (step 530). The current chute bearing is calculated by first adding the snowthrower bearing to the chute angle (the angle of the chute 310 relative to the body 305), if the result is greater than or equal to 360°, then the current chute bearing is set to the current chute bearing minus 360° and if the result is less than 0°, the current chute bearing is set to the current chute bearing plus 360°.

Next, the electronic control unit 415 determines if the target or preferred chute bearing is possible (step 535). If the preferred chute bearing is not possible, the chute 305 is rotated in the direction of least travel towards the preferred chute bearing until the chute reaches the angular limit of the chute's travel in that direction (step 540). If the preferred chute bearing is possible, the heading error is calculated (step 545) and the motor 410 rotates the chute 305 to eliminate the heading error (e.g., so the heading error is zero) (step 550).

In some embodiments, the following calculation is used to determine if the preferred chute bearing is possible. First, the bearing change is set as the preferred chute bearing minus the snowthrower bearing. If the bearing change is less than 0°, the change check is set to the bearing change plus 360° and if the bearing change is greater than or equal to 0°, the change check is set to the bearing change minus 360°. Next, if the absolute value of the change check is less than or equal to the absolute value of the bearing change, the bearing change is set to the change check. Finally, if the absolute value of the bearing change is less than or equal to the angular limit of the chute's travel (e.g., 105°), then the target bearing is possible; if not, the target bearing is not possible.

In some embodiments, the following calculation is used to determine the target bearing error. This is done to account for the "rollover" from 0° to 360° at magnetic North. The target change is the difference between the preferred chute bearing and the current chute bearing. When rollover occurs, the "calculated" target change is much greater than the "true" target change. First the target change is set as the preferred chute bearing minus the current chute bearing. If the target change is less than 0°, the change check is set as the target change plus 360°; otherwise, the change check is set as the target change minus 360°. If the absolute value of the change check is less than or equal to the absolute value of the target change (i.e., the "original" or "calculated" target change), the "true" target change is the change check. If not, the "true" target change is the "original" or "calculated" target change. That is, if the absolute value of the change check is less than or equal to the absolute value of the target change, the target change is set as the change check.

In some embodiments, when the target change is positive, the chute 305 is rotated clockwise. When the target change is negative the chute 305 is rotated counterclockwise. IN some embodiments, the absolute value of the target change dictates the motor speed used to rotate the chute. When the absolute value of the target change is relatively high, the motor speed is also relatively high (e.g., the PWM duty cycle is large) to quickly move the chute to the preferred chute bearing. When the absolute value of the target change is relatively low, the motor speed is also relatively low. In some embodiments, a dead band where the chute 305 is not rotated is used to prevent unstable chute movement when the change target is near zero.

In a target tracking operating mode, the chute position control system 400 automatically changes the chute position to direct the discharged snow at a designated target (e.g. a stationary target area). The designated target is selected by the user. This can be done is several ways. In some embodiments, the user selects the designated target by using GPS (e.g., entry of coordinates manually, on a map, or other appropriate manner). In some embodiments, the user sets the chute position and the deflector position so that discharged snow hits a desired target. This target is saved or stored as the designated target by actuating a switch (e.g., setting the mode selection switch 445 to target tracking mode, actuating the preferred chute direction switch 455, etc.). As the user operates the snowthrower 300, the electronic control unit 415 compares the current position of the snowthrower 300, as detected by the GPS sensor 440, to the designated target and automatically adjusts the chute position so that snow is discharged to the designated target. In some embodiments, the snow thrower 300 includes a second motor 470 for changing the position of the deflector 330. The second motor 470 is connected to the electronic control unit 415, so that the position of the deflector 330 and the angle of discharge can be controlled (e.g., by a user-operated switch 475 on the control interface 315 or automatically). The distance snow is discharged from the chute 305 depends in part on the angle of discharge set by the deflector 330 and the weight of the snow. Automatic control of the deflector 330 helps to direct discharged snow to the designated target. In some embodiments, the weight of the snow is detected or set by the user. For example, the user may use the control interface 315 to enter a relative weight of the snow (e.g. light, average, heavy, dry, wet, etc.) into the electronic control unit 415. This information can then be used by the electronic control unit 415 when determining the proper chute and deflector positions to discharge snow to the designated target.

While the above exemplary embodiments pertain solely to a chute control system for snowthrowers, it is to be understood that the invention is not limited in this way. That is, compass-guided chute control systems in accordance with the invention could be similarly applied to directionally-aimed chutes or other devices on agricultural, construction, or other equipment.

The construction and arrangements of the snowthrower chute control system, as shown in the various exemplary embodiments above, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the invention.

What is claimed is:

1. A snowthrower comprising:

a body;

a chute rotatable relative to the body among a plurality of chute positions, wherein the chute is configured to discharge snow from the snowthrower;

a motor for rotating the chute;

a user input device configured to set a preferred chute bearing;

an electronic control unit configured to control the motor to automatically rotate the chute to an appropriate chute position to maintain the chute at the preferred chute bearing without additional input from the user input device.

2. The snowthrower of claim 1, wherein the electronic control unit is configured to:

store the preferred chute bearing in a memory device of the electronic control unit;

calculate a current chute bearing;

determining if the preferred chute bearing is possible;

if the preferred chute bearing is possible, calculate the bearing error and then rotate the chute with the motor to eliminate the bearing error; and if the preferred chute bearing is not possible, rotate the chute with the motor toward the preferred chute bearing until the chute reaches an angular travel limit.

3. The snowthrower of claim 2, wherein the chute is rotatable between a clockwise angular limit and a counterclockwise angular limit; and further comprising:

a clockwise limit switch configured to be actuated when the chute is at the clockwise angular limit and wherein actuation of the clockwise limit switch prevents the chute from further clockwise rotation; and a counterclockwise limit switch configured to be actuated when the chute is at the counterclockwise angular limit and wherein actuation of the counterclockwise limit switch prevents the chute from further counterclockwise rotation.

4. The snowthrower of claim 1, further comprising:

a mode selection switch configured to select a manual operating mode or an automatic operating mode; and a chute direction switch, wherein the electronic control unit is further configured to, in the manual operating mode, control the motor to move the chute in response to actuation of the chute direction switch;

wherein, in the automatic operating mode, the electronic control unit is configured to control the motor to rotate the chute to the appropriate chute position to maintain the chute at the preferred chute bearing without additional input form the user input device.

5. The snowthrower of claim 4, further comprising an indicator, wherein, in the automatic operating mode, the electronic control unit is configured to activate the indicator when the electronic control unit determines that the chute cannot rotate to the appropriate chute position.

6. The snowthrower of claim 1, further comprising:

a chute position detector configured to detect a current chute position;

a compass sensor configured to detect a snowthrower bearing; and wherein the electronic control unit is configured to compare the snowthrower bearing detected by the compass sensor and the current chute position detected by the chute position detector to determine the appropriate chute position to maintain the chute at the preferred chute bearing.

7. The snowthrower of claim 6, wherein the chute position detector includes a lead screw mechanically coupled to the chute so that the rotation of the chute rotates the lead screw, a target member coupled to the lead screw so that rotation of the lead screw causes linear movement of the target member, and a position sensor configured to detect a distance between the target member and the position sensor, wherein the distance between the target member and the position sensor is indicative of the current chute position.

8. A snowthrower comprising:

a body;

a chute rotatable relative to the body among a plurality of chute positions, wherein the chute is configured to discharge snow from the snowthrower;

a motor for rotating the chute;

a flip user input device; and an electronic control unit configured to automatically control the motor to move the chute to a flip position one hundred eighty degrees from a current chute position upon actuation of the flip user input device.

9. The snowthrower of claim 8, wherein the chute is rotatable between a clockwise angular limit and a counterclockwise angular limit; and further comprising:

a clockwise limit switch configured to be actuated when the chute is at the clockwise angular limit and wherein actuation of the clockwise limit switch prevents the chute from further clockwise rotation; and a counterclockwise limit switch configured to be actuated when the chute is at the counterclockwise angular limit and wherein actuation of the counterclockwise limit switch prevents the chute from further counterclockwise rotation.

10. The snowthrower of claim 9, further comprising:

a chute position detector configured to detect the current chute position.

11. The snowthrower of claim 10, wherein the chute position detector includes a lead screw mechanically coupled to the chute so that the rotation of the chute rotates the lead screw, a target member coupled to the lead screw so that rotation of the lead screw causes linear movement of the target member, and a position sensor configured to detect a distance between the target member and the position sensor, wherein the distance between the target member and the position sensor is indicative of the current chute position.

12. The snowthrower of claim 8, further comprising:

a chute position detector configured to detect the current chute position.

13. The snowthrower of claim 12, wherein the chute position detector includes a lead screw mechanically coupled to the chute so that the rotation of the chute rotates the lead screw, a target member coupled to the lead screw so that rotation of the lead screw causes linear movement of the target member, and a position sensor configured to detect a distance between the target member and the position sensor, wherein the distance between the target member and the position sensor is indicative of the current chute position.

14. The snowthrower of claim 8, wherein the electronic control unit is further configured to automatically control the motor to move the chute from the flip position back to the current chute position upon subsequent actuation of the flip user input device.

15. A snowthrower comprising:

a body;

a chute rotatable relative to the body among a plurality of chute positions, wherein the chute is configured to discharge snow from the snowthrower;

a motor for rotating the chute;

a mirror user input device; and an electronic control unit configured to automatically control the motor to move the chute to a mirror position from a current chute position upon actuation of the mirror user input device, wherein the current chute position and the mirror position are equally and oppositely spaced from a snowthrower unit heading.

16. The snowthrower of claim 15, further comprising:

a chute position detector configured to detect the current chute position.

17. The snowthrower of claim 16, wherein the chute position detector includes a lead screw mechanically coupled to the chute so that the rotation of the chute rotates the lead screw, a target member coupled to the lead screw so that rotation of the lead screw causes linear movement of the target member, and a position sensor configured to detect a distance between the target member and the position sensor, wherein the distance between the target member and the position sensor is indicative of the current chute position.

18. The snowthrower of claim 16, wherein the electronic control unit is further configured to control the motor to move the chute from the mirror position back to the current chute position upon subsequent actuation of the mirror switch.

19. The snowthrower of claim 15, wherein the electronic control unit is further configured to automatically control the motor to move the chute from the mirror position back to the current chute position upon subsequent actuation of the mirror user input device.

* * * * *